US008325007B2

(12) United States Patent
Smith et al.

(10) Patent No.: US 8,325,007 B2
(45) Date of Patent: Dec. 4, 2012

(54) SURFACE MOUNT RESISTOR WITH TERMINALS FOR HIGH-POWER DISSIPATION AND METHOD FOR MAKING SAME

(75) Inventors: Clark L. Smith, Columbus, NE (US); Todd L. Wyatt, Columbus, NE (US); Thomas L. Bertsch, Norfolk, NE (US); Rodney J. Brune, Columbus, NE (US)

(73) Assignee: Vishay Dale Electronics, Inc., Columbus, NE (US)

( * ) Notice: Subject to any disclaimer, the term of this patent is extended or adjusted under 35 U.S.C. 154(b) by 340 days.

(21) Appl. No.: 12/650,079

(22) Filed: Dec. 30, 2009

(65) Prior Publication Data

US 2011/0156860 A1 Jun. 30, 2011

Related U.S. Application Data

(60) Provisional application No. 61/290,429, filed on Dec. 28, 2009.

(51) Int. Cl.
*H01C 1/14* (2006.01)

(52) U.S. Cl. ..... 338/328; 338/309; 338/322; 338/332; 338/293

(58) Field of Classification Search ..... 338/159, 338/307–309, 313, 322, 327–329, 332, 293; 29/610.1
See application file for complete search history.

(56) References Cited

U.S. PATENT DOCUMENTS

| | | | | |
|---|---|---|---|---|
| 4,087,778 | A * | 5/1978 | Merz et al. | 338/309 |
| 4,130,671 | A * | 12/1978 | Nagesh et al. | 427/125 |
| 4,801,469 | A * | 1/1989 | Norwood | 427/103 |
| 5,287,083 | A * | 2/1994 | Person et al. | 338/332 |
| 5,604,477 | A | 2/1997 | Rainer et al. | |
| 5,990,780 | A * | 11/1999 | Caddock, Jr. | 338/309 |
| 6,794,956 | B2 * | 9/2004 | Taniguchi et al. | 333/172 |
| 7,053,749 | B2 * | 5/2006 | Ishida et al. | 338/324 |
| 7,089,652 | B2 * | 8/2006 | Akhtman et al. | 29/610.1 |
| 7,190,252 | B2 | 3/2007 | Smith et al. | |
| 2004/0233032 | A1 | 11/2004 | Schneekloth et al. | |
| 2004/0263150 | A1 | 12/2004 | Hetzler | |

FOREIGN PATENT DOCUMENTS

| | | |
|---|---|---|
| EP | 0716427 A2 | 6/1996 |
| JP | 08222401 | 8/1996 |
| JP | 2008235523 | 10/2008 |
| TW | 253088 | 4/2006 |

OTHER PUBLICATIONS

Feb. 10, 2011 Int'l Search Report issued in corresponding PCT Appln. No. PCT/US2010/055804.
Isabellenhutte SMD precision resistor technical data sheet. (Issued Nov. 3, 2008).

* cited by examiner

*Primary Examiner* — Kyung Lee
(74) *Attorney, Agent, or Firm* — Volpe and Koenig, P.C.

(57) ABSTRACT

A metal strip resistor is provided with a resistive element disposed between a first termination and a second termination. The resistive element, first termination, and second termination form a substantially flat plate. A thermally conductive and electrically non-conductive thermal interface material such as a thermally conductive adhesive is disposed between the resistive element and first and second heat pads that are placed on top of the resistive element and adjacent to the first and second terminations, respectively.

38 Claims, 9 Drawing Sheets

SURFACE MOUNT RESISTOR WITH TERMINALS FOR HIGH-POWER DISSIPATION AND METHOD FOR MAKING SAME

CROSS REFERENCE TO RELATED APPLICATION

This application claims the benefit of U.S. Provisional Application No. 61/290,429, which is incorporated by reference as if fully set forth.

FIELD OF INVENTION

This application is generally related to surface mount electrical resistors and in more particular relates to surface mount resistors configured for high-power dissipation and methods for making the same.

BACKGROUND

Surface mount electrical resistors are used in numerous electronic systems and devices. As these systems and devices continue to decrease in size, the dimensions of their electrical components must also decrease accordingly. While the physical size of electrical systems and their components have gotten smaller, the power requirements of these systems have not necessarily reduced in magnitude. Therefore, the heat generated by the components must be managed in order to maintain safe and reliable operating temperatures for the systems.

Resistors can have many different configurations. Some of these configurations lack efficient heat dissipation capabilities. During operation, typical resistors can develop hot spots in the center of the resistive element (e.g., away from the heat sinking benefits of the electrical leads). Overheated resistive material is susceptible to changes in resistivity, resulting in a resistor that shifts out of tolerance over its life or during periods of power overloading. This problem is particularly acute in high-current or pulsed applications requiring very small components. Some resistor configurations are limited to resistors with larger form factors. As the size of the resistor decreases, it becomes increasingly difficult to provide adequate heat dissipation capabilities.

Therefore, it is desirable to provide improved surface mount resistors with enhanced heat dissipation capabilities and methods for making such devices. It is also desirable to provide improved surface mount resistors with enhanced heat dissipation configurations that are suitable for small resistor sizes. It is also desirable to provide an improved surface mount resistors with enhanced heat dissipation that are economical in manufacture, durable in use, and efficient in operation.

SUMMARY

A metal strip resistor with improved high-power dissipation and method for making same is disclosed. The resistor has a resistive element disposed between a first termination and a second termination. The resistive element, first termination, and second termination form a substantially flat plate. A thermally conductive and electrically non-conductive thermal interface material, such as a thermally conductive adhesive, is disposed between the resistive element and first and second heat pads that are placed on top of the resistive element and adjacent to the first and second terminations, respectively.

DETAILED DESCRIPTION

Figure 1:
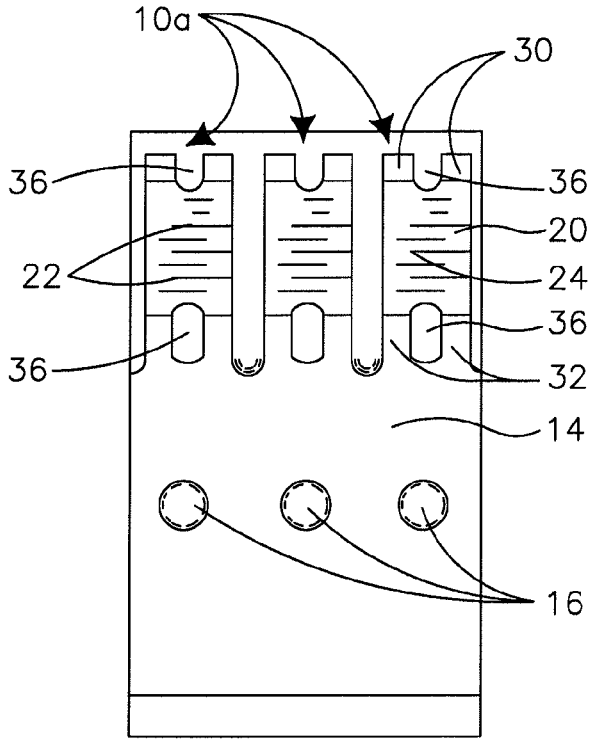
FIG. 1 illustrates a plurality of metal strip resistors disposed on a carrier strip.

FIGS. 1-5 show a metal strip resistor in various stages of assembly. For purposes of clarity, the metal strip resistor is labeled 10*a*-10*i* denoting the various stages of manufacture and/or embodiment. Referring to FIG. 1, a plurality of metal strip resistors 10*a* are shown disposed on a carrier strip 14. The carrier strip may include a plurality of index holes 16 to align the carrier strip during manufacturing. Each metal strip resistor 10*a* includes a resistive element 20 disposed between a first termination 30 and a second termination 32. The resistive element 20, first termination 30, and second termination 32 form a substantially flat plate. The first and second terminations 30, 32 may be welded to opposing ends of the resistive element 20. The resistance value of the resistive element 20 is generally defined by the electrical characteristic of the resistive material (e.g., resistivity) and its physical configuration. This configuration forms a self supporting metal strip resistor that does not require a separate substrate for support. See e.g., U.S. Pat. No. 5,604,477, which is incorporated by reference in its entirety.

Figure 2:
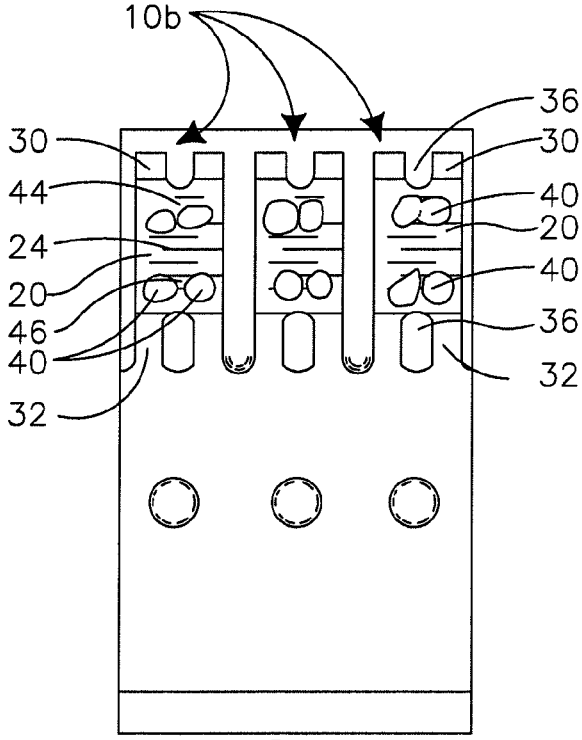
FIG. 2 illustrates a plurality of metal strip resistors with an adhesive disposed on the resistive element.

The resistance value of the resistive element 20 may be adjusted by laser trimming, nibbling, grinding, or any other suitable means. FIGS. 1 and 2 show laser trimmings 22 on a top surface 24 of the resistive element 20. It should be understood that trimming or resistance adjustment operations may be carried out on other surfaces of the resistive element 20. Alternatively, the resistive element 20 may be left untrimmed.

The resistive element may be made out of any suitable electrically resistive material, including for example nickel-chromium and copper alloys. Such materials are available from a variety of sources, for example under the trade names of EVANOHM and MANGANIN. The first and second terminations 30, 32 may be made from a variety of materials including copper, such as C102, C110, or C151 copper. C102 copper is desirable because of its high purity and good electrical conductivity. C151 copper may be useful in high temperature applications. It should be understood that other well known electrically conductive materials may also be used to form the first and second terminations 30, 32.

FIG. 2 shows an uncured thermal interface material, in this case an adhesive 40, disposed on the resistive element 20. In this example, the adhesive 40 is dispensed in several discrete locations to promote even coverage. It should be understood that a variety of dispensing patterns may be utilized as discussed in more detail below. The adhesive 40 is thermally conductive and electrically non-conductive, and may be any adhesive having these desired properties. In this embodiment the adhesive is a thermally conductive, one-part, liquid silicon adhesive available under the trade name Berquist Liqui-Bond® SA 2000. However, other thermal interface materials may also be used. Such materials are typically filled with high thermal conductivity solids. For example, the adhesive 40 may be comprised of a polymer containing spherical alumina particles. The spherical alumina particles provide electrical insulation and heat dissipation between the resistive element 20 and the first and second heat pads 50, 52. The spherical alumina particles also act as a spacer between the resistive element 20 and the first and second heat pads 50, 52. The desired spacing may be achieved by adjusting the diameter of the alumina spheres in the adhesive 40. The adhesive 40 may be dispensed by any suitable means, such as a pneumatically driven syringe system, positive displacement screw systems and the like.

The adhesive 40 shown in FIG. 2 is dispensed on at least two separate locations, e.g., first location 44 and second location 46, on the top surface 24 of the resistive element 20. The first location 44 is adjacent to the first termination 30 and the second location 46 is adjacent to the second termination 32. When the first and second heat pad 50, 52 are placed on top of the adhesive 40 at the first and second locations 44, 46, respectively, the first heat pad 50 is adjacent to the first termination 30 and the second heat pad 52 is adjacent to the second termination 32. The first and second heat pads 50, 52 may contact the first and second terminations 30, 32, respectively (e.g., thermal contact), thus allowing heat transfer between the heat pads 50, 52 and the terminations 30, 32. It should be understood that some of the adhesive 40 may flow in the gap formed between the heat pads 50, 52.

Figure 3:
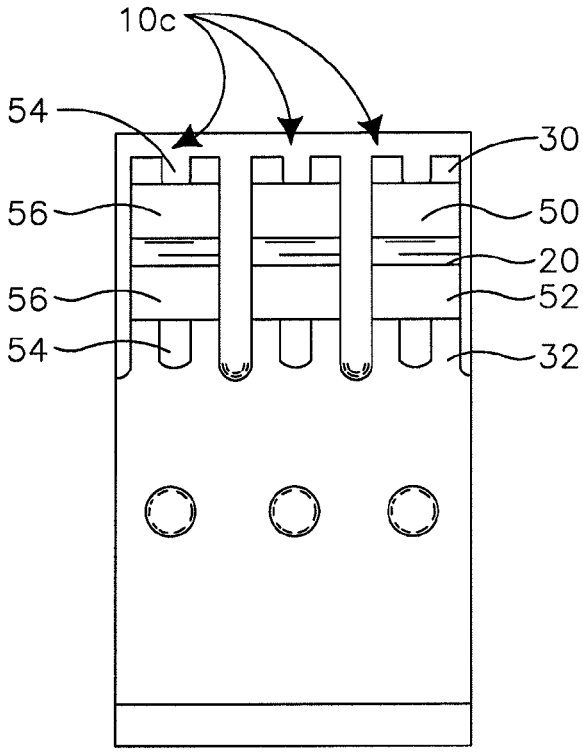
FIG. 3 illustrates a plurality of metal strip resistors with heat pads.

FIG. 3 shows first and second heat pads 50, 52 placed on top of the resistive element 20 and adjacent to the first termination 30 and the second termination 32, respectively. Optionally, the first and second heat pads 50, 52 may also be in thermal contact with and/or electrically connected to the first and second terminations 30, 32, respectively. The adhesive 40 is disposed between the resistive element 20 and the first and second heat pads 50, 52. The adhesive is uncured during this operation. After the first and second heat pads 50, 52 are placed on top of the resistive element 20, they may be pressed towards the resistive element 20. As shown in detail in FIG. 6, the adhesive 40 spreads between the heat pads 50, 52 and the resistive element 20. The resulting coating has a thickness 42, also known as a bond margin, which separates the heat pads 50, 52 from the resistive element 20. This bond margin 42 provides electrical insulation between the resistive element 20 and the first and second heat pads 50, 52. The thickness of the bond margin may be approximately (but not necessarily) the diameter of the thermal conductivity solids present in the thermal interface material. Accordingly, the bond margin 42 provides a highly thermally conductive path between the resistive element 20 to the first and second heat pads 50, 52. The adhesive 40 is uncured during the formation of the bond margin 42, allowing the adhesive to flow into any resistance trimmings 22 and other imperfections in the surface of the resistive element 20 and heat pads 50, 52. This also promotes good thermal contact between the heat pads 50, 52 and the resistive element 20 and promotes heat transfer between the parts. The resulting structure provides an efficient mechanism to dissipate heat from the resistive element 20. Once the heat pads 50, 52 are set into the adhesive 40, the assembly may be heated to cure the adhesive 40. If Berquist Liqui-Bond® SA 2000 is used as the adhesive 40, a typical curing schedule is approximately 20 minutes at 125° C. or 10 minutes at 150° C. Alternatively, the adhesive 40 may be allowed to cure at room temperature (25° C.) for 24 hours. It should be understood that curing of the thermal interface material is optional.

The first and second heat pads 50, 52 may be made out of any material suitable for heat dissipation. For example, the first and second heat pads 50, 52 may be made from the same electrically conductive material as the first and second terminations 30, 32, such as copper.

Figure 4:
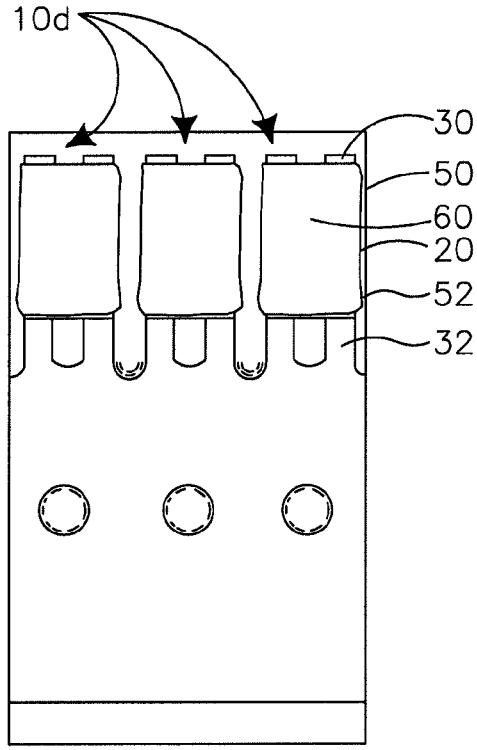
FIG. 4 illustrates a plurality of metal strip resistors with a coating disposed over the heat pads and resistive element.
Figure 7:
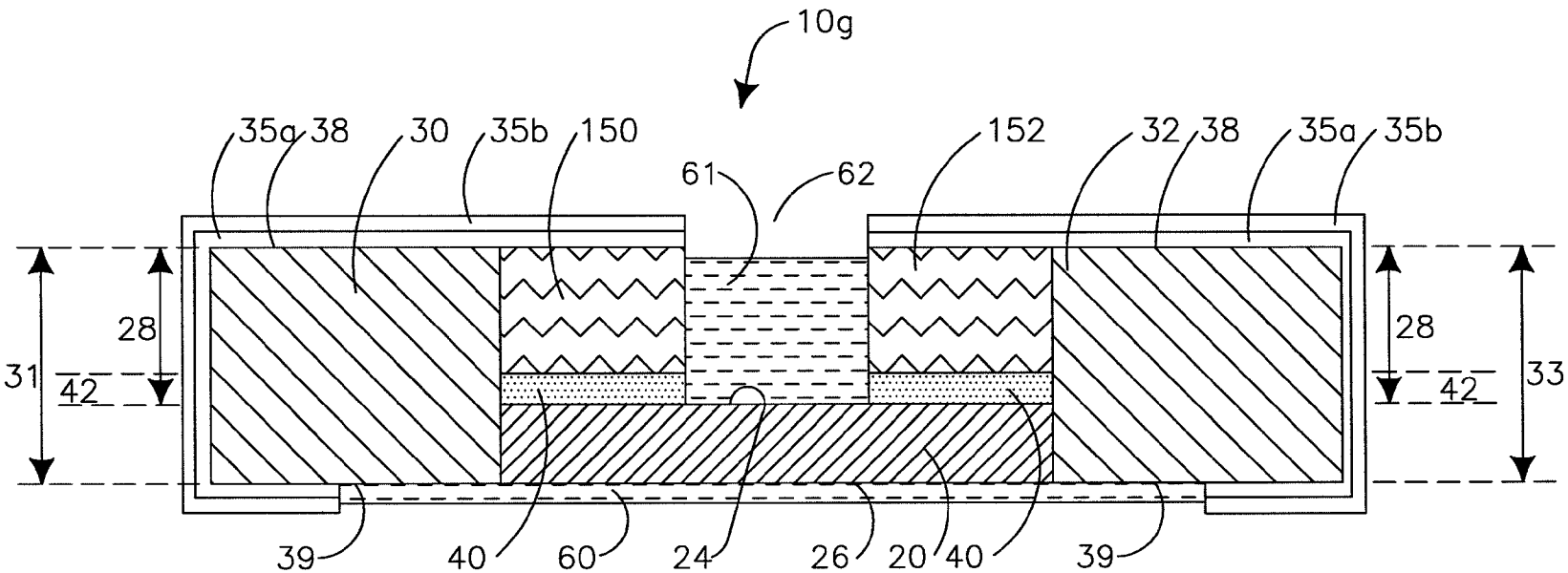
FIG. 7 is another embodiment shown in sectional view.

As shown in FIG. 4, the metal strip resistor 10*d* may include a coating 60 disposed over the first and second heat pads 50, 52 and the resistive element 20. The coating 60 may be made out of any suitable electrically non-conductive, i.e. dielectric, material. For example, a silicon polyester material may be used. In one embodiment, the coating covers the heat pads 50, 52 and is wrapped around the entire resistive element 20. The coating 60 does not cover the first and second terminations 30, 32, which are used for the electrical connection to a circuit. The coating 60 may be cured to harden it to prevent cracking. The coating 60 may provide additional strength and chemical resistance for the metal strip resistor 10*d*. The coating 60 may also provide an area for marking the resistor. In another embodiment, the coating on one side of the resistor (as shown by reference number 61 in FIG. 7) may be applied primarily in the gap 62 formed between the heat pads 150, 152. This may allow a portion of the heat pads to function as electrical terminations. FIG. 7 also shows the coating wrapped around the other side of the resistor (as shown by reference number 60). The dielectric material used for the coating 60 is preferably a rolled epoxy, but various types of paint, silicon, and glass in the forms of liquid, powder, or paste may be used. The coating 60 may be applied by conventional methods including molding, spraying, brushing, static dispensing, roll coating, or transfer printing.

Figure 5:
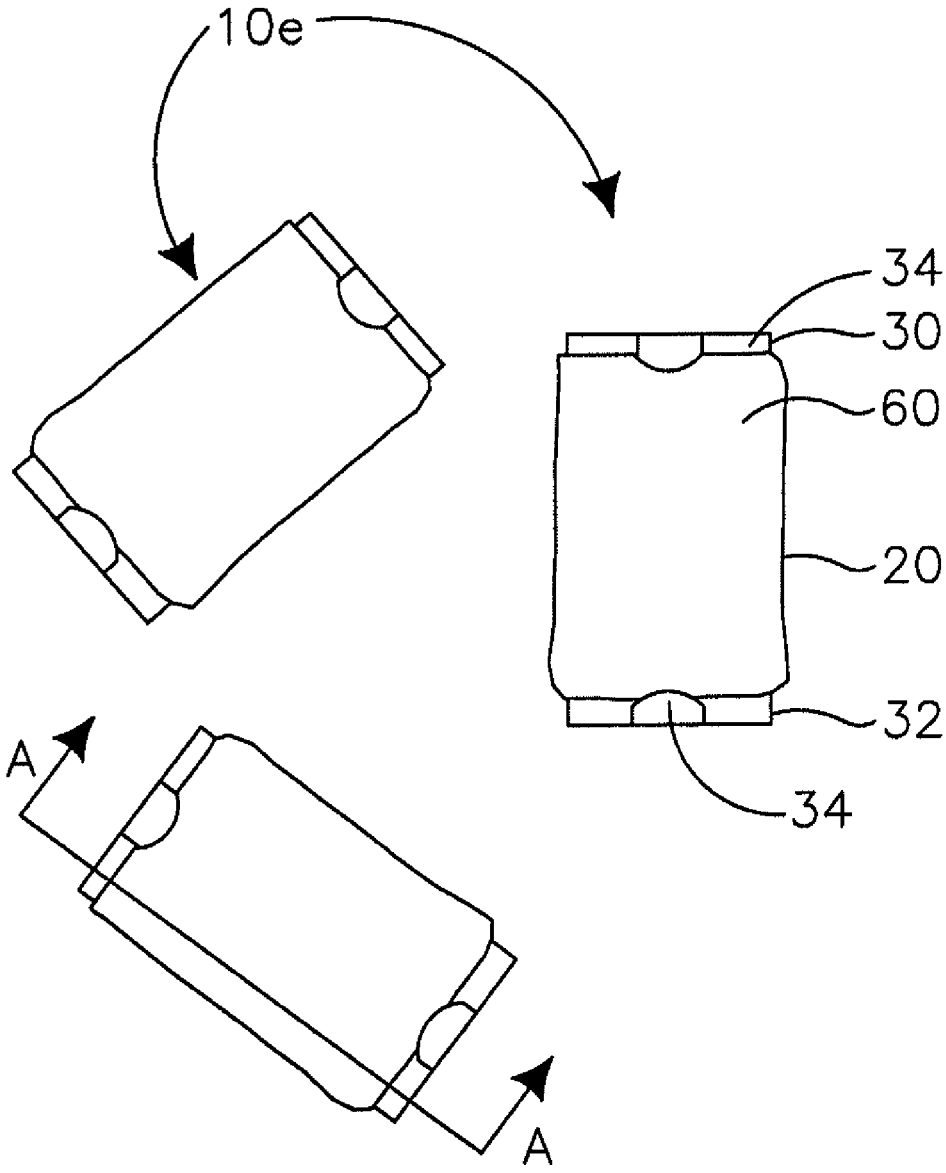
FIG. 5 illustrates a plurality of metal strip resistors separated from the carrier strip.
Figure 6:
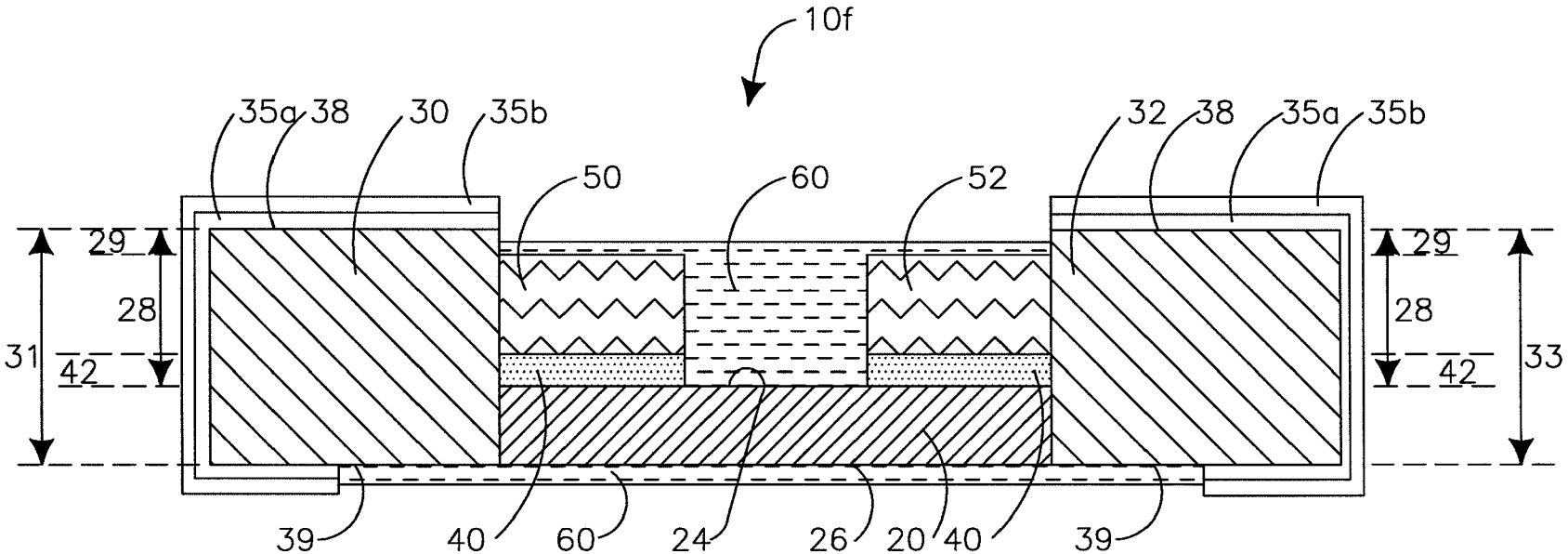
FIG. 6 is a sectional view taken along line A-A of FIG. 5.
Figure 8:
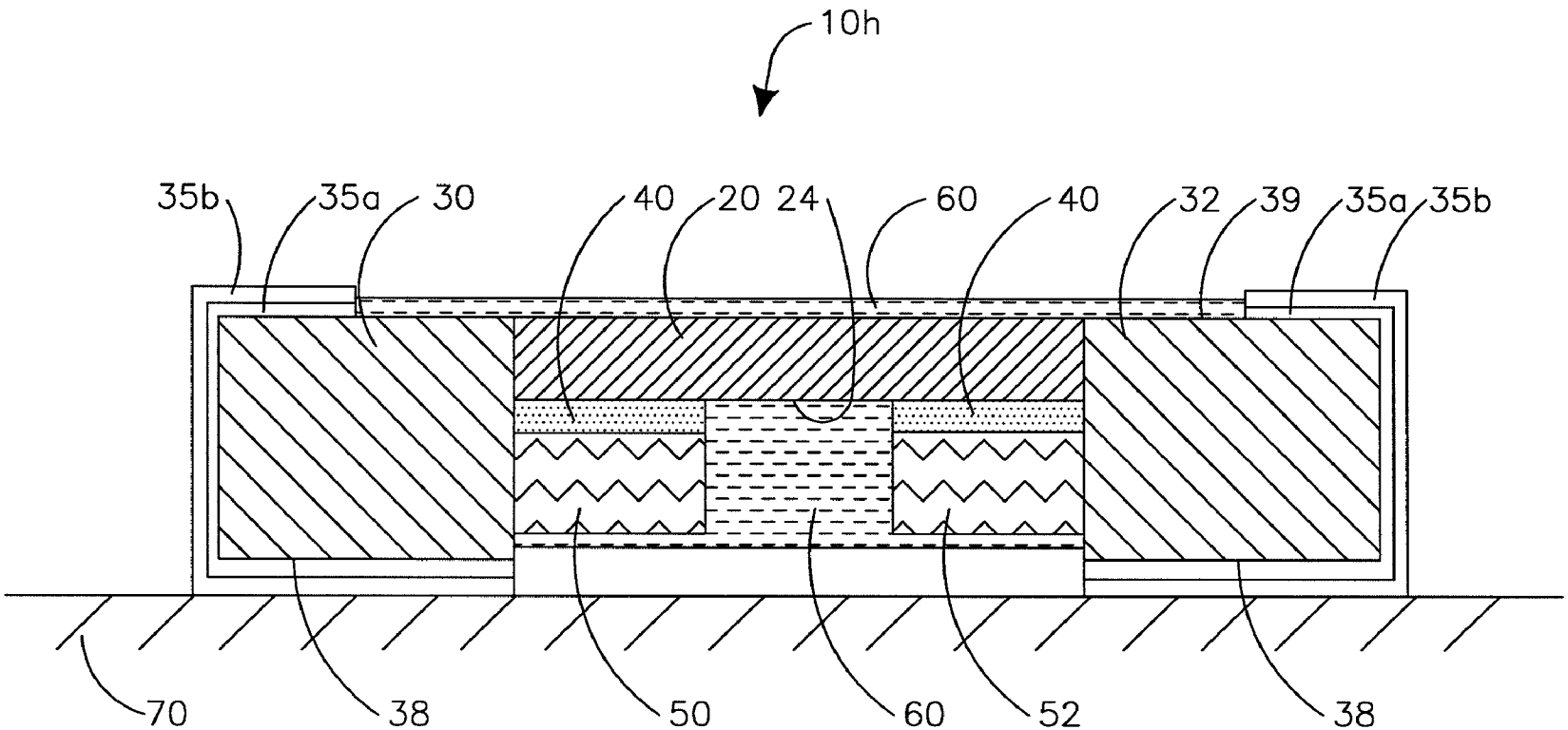
FIG. 8 is a sectional view of a resistor when mounted to a printed circuit board.

FIG. 5 shows the metal strip resistors 10*e* separated from the carrier strip 14. This may be done by conventional singulation equipment such as a shearing die. The first and second terminations 30, 32 may then be plated as shown in FIGS. 6-8. The first and second terminations 30, 32 may be barrel plated in a two step process: a first layer 35*a* of nickel is deposited on the terminations 30, 32; then, a second layer 35*b* of tin is deposited over the layer of nickel. The metal strip resistor is then washed and dried to remove any plating solutions. In addition to nickel and tin, the first and second plating layers 35*a*, 35*b* may be of any suitable material. The plating 34 on the first and second terminations 30, 32 help protect the material of the terminations 30, 32 from corrosion, adds mechanical strength to the terminations 30, 32, and ensures adequate electrical connection and heat transfer between the heat pads 50, 52 and the terminations 30, 32. The plating may also cover a portion of the heat pads in embodiments utilizing the heat pads as electrical terminations, (see e.g., FIG. 7).

As shown in FIG. 1, each of the first and the second terminations 30, 32 may optionally be formed with a bifurcation 36. The first and second heat pads 50, 52 may optionally be formed with a tab portion 54 and a pad portion 56. See e.g., FIG. 3. The tab portion 54 is configured to fit in between the bifurcation 36 of the first and second terminations 30, 32. The fit between the tab portion 54 and bifurcation 36 may be a slip fit, an interference fit or a location fit (e.g., held securely, yet not so securely that it cannot be disassembled). The quantity of adhesive 40 may be selected such that the adhesive 40 provides good coverage yet only contacts the pad portion 56 (e.g., to minimize squeeze out), leaving the tab portion 54 substantially free of adhesive 40. The fit may also be adjusted to minimize squeeze out between the tab portion 54 and the bifurcation 36.

A coating 60 may be applied to the metal strip resistor 10*d* as discussed above. The coating 60 may cover only the pad portion 56, and not the tab portion 54, of the heat pads 50, 52. First and second terminations 30, 32 of the metal strip resistor 10 may then be plated. This allows the plating 34 to cover both the terminations 30, 32 and the tab portions 54 adapted to fit in between the bifurcations 36. This strengthens the mechanical, thermal and electrical contact between the heat pads 50, 52 and the terminations 30 and 32 respectively. In the alternative, the coating may be applied such that a portion of the pad portion 56 is exposed. In this case, the exposed portion of the pad portion 56 may also be plated.

FIG. 6 shows a sectional view taken along line A-A of FIG. 5. It should be understood that the resistive element 20, first termination 30, and second termination 32 may be formed with a variety of thicknesses. It should also be understood that the assembly may be formed with various alignments between resistive element 20 and the first and second terminations 30, 32. The resistive element 20 has a thickness defined between a top surface 24 and a bottom surface 26. The resistive element 20 is electrically coupled to and disposed between the first and second terminations 30, 32. The first and second terminations 30, 32 each have a thickness 31, 33 defined between a top surface 38 and a bottom surface 39. In this embodiment, the thickness 31 of the first termination 30 is substantially equal to the thickness 33 of the second termination 32 and the terminations are thicker than the resistive element 20.

The bottom surface 26 of the resistive element 20 may be generally flush with the bottom surfaces 39 of the first and second terminations 30, 32. This arrangement results in a distance 28 between the top surfaces 38 of the terminations 30, 32 and the top surface 24 of the resistive element 20, and a stand-off distance 29 between the top surfaces 38 of the terminations 30, 32 and the top surfaces of the heat pads 50, 52. When the metal strip resistor 10*f* is mounted to a mounting surface, such as a printed circuit board, the top surfaces 38 of the first and second terminations 30, 32 contact the printed circuit board and the resistive element 20 is suspended above the printed circuit board. In this embodiment, the first and second heat pads 50, 52 have substantially equal thicknesses, and the adhesive 40 also has a thickness 42, (i.e. bond margin), that electrically isolates the heat pads 50, 52 from the resistive element 20. The bond margin 42 is preferably kept to a minimum (e.g., approximately the diameter of the thermally conductive solids present in the thermal interface material) to maximize heat transfer from the resistive element 20 to the heat pads 50, 52. The coating 60 is disposed over the heat pads 50, 52 and the resistive element 20. It is desirable for the sum of the thicknesses of the resistive element 20, adhesive 40, heat pads 50, 52, and coating 60 to be less than the thickness of the first and second terminations 30, 32. In such an arrangement, when the metal strip resistor is mounted on a surface, the top surfaces 38 of the terminations 30, 32 contact the mounting surface to form an electrical connection without interference from the coating 60.

The thicknesses of the first and second terminations 30, 32 typically range from 0.01 inches to 0.04 inches (~0.25-1.0 mm). For example, the metal strip resistor 10*f* shown in FIG. 6 may be formed such that the resistive element 20 has a thickness of 0.0089 inches (~0.23 mm). In this example, the adhesive 40 has a bond margin 42 of 0.002 inches (~0.05 mm), the heat pads 50, 52 each have a thickness of 0.004 inches (~0.1 mm), and the terminations 30, 32 each has a thickness of 0.02 inches (~0.51 mm). This results in a stand-off distance 29 of 0.0051 inches (~0.13 mm) between the top surfaces 38 of the terminations 30, 32 and the top surfaces of the heat pads 50,52. Therefore, the coating 60 is applied over the heat pads 50, 52 and resistive element 20 to at least partially fill the stand-off distance 29 without exceeding the height of the top surfaces 38 of the terminations 30, 32. In this example, the thickness of the coating 60 above the heat pads 50, 52 would typically be approximately 0.0051 inches (~0.13 mm) or less.

FIG. 8 shows a metal strip resistor 10*h* mounted to a printed circuit board 70. The first and second terminations 30, 32 contact the surface of the printed circuit board 70 to form an electrical connection. The printed circuit board 70 may include two or more electrical conductors, and the first and second terminations 30, 32 may be attached to those two or more electrical conductors. FIG. 7 shows an embodiment having the first and second terminations 30, 32 as well as the first and second heat pads 150, 152 configured for connection to electrical conductors on a printed circuit board. In this arrangement, the heat pads 150, 152 dissipate heat from the resistive element 20 and also act as terminations and form electrical connections with the printed circuit board.

Figure 9:
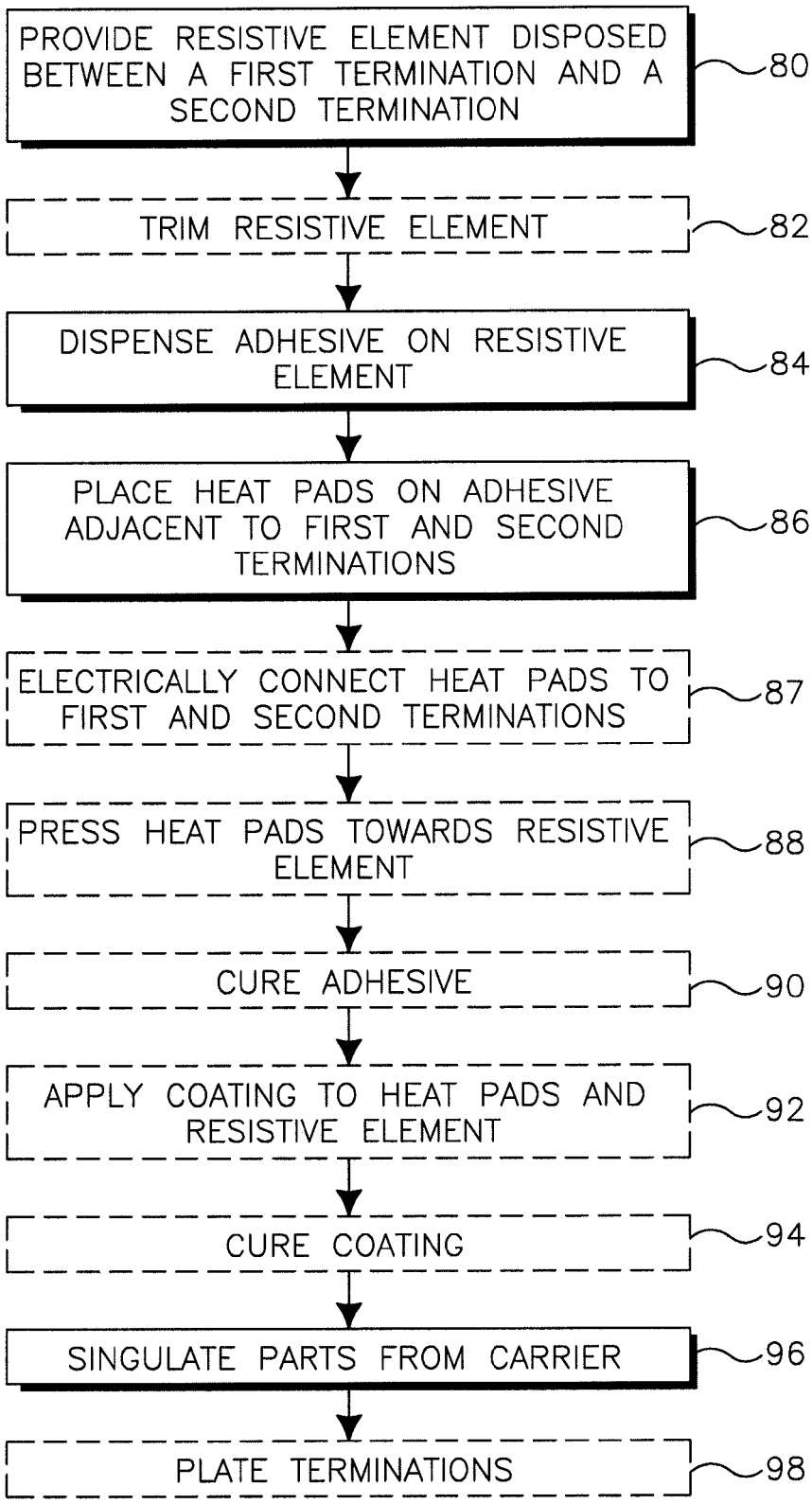
FIG. 9 is a flow diagram showing the process for making a metal strip resistor according to one embodiment.

FIG. 9 is a flow diagram showing the method for making a metal strip resistor as discussed above. Reference numbers to the embodiments shown in FIGS. 1-4 are included. It should be understood that other embodiments may be made using the disclosed method. The method includes first providing a resistive element 20 disposed between a first termination 30 and a second termination 32 as shown by block 80. The resistive element 20 and terminations 30, 32 are arranged to form a substantially flat plate, although it need not be substantially flat. Optionally, the resistance value of the resistor 10 may be adjusted by trimming the resistive element 20 as shown by block 82. A thermal interface material such as a thermally conductive and electrically non-conductive adhesive 40 is dispensed onto the resistive element 20 as shown by block 84. First and second heat pads 50, 52 are then placed on top of the adhesive 40 adjacent to the first and second terminations 30, 32, respectively, as shown by block 86. The placement of the first and second heat pads 50, 52 may put the heat pads 50, 52 in thermal contact with the terminations 30, 32. The first and second heat pads 50, 52 may be optionally electrically connected to the first and second terminations 30, 32, respectively, as shown by block 87. The heat pads 50, 52 may be pressed towards the resistive element 20 as shown by block 88. Pressing is not required, but may be beneficial since it may help spread the adhesive 40 the across the surface of the resistive element 20 and into any surface imperfections and trimmings 22. This provides additional heat transfer from resistive element 20 to the heat pads 50, 52. The pressing operation may also be used to achieve a desired adhesive thickness, i.e. bond margin 42. To ensure maximum heat transfer, it is desirable to keep the bond margin 42 to a minimum as discussed above. The adhesive may be cured as shown by block 90 (e.g., by applying heat or at room temperature when using a curing type thermal interface material). Examples of adhesives and curing schedules are discussed in detail above. A coating 60 may be optionally applied to the heat pads 50, 52 and resistive element 20 as shown by block 92. The coating 60 may be applied by various known techniques as discussed above. For example, a two step process may be used where the coating 60 is first applied to the top surface 24 of the resistive element 20 including the heat pads 50, 52, and then applied to the bottom surface 26 of the resistive element 20. While coating the top and bottom surfaces 24, 26 of the resistive element 20, some wraparound occurs around the edges of the resistive element, such that at the end of the coating process as shown by block 92, the resistive element 20 is encapsulated by the coating 60. The coating 60 may then be cured by heat or by resting at room temperature as shown by block 94. If a carrier strip 14 is used, individual resistors may be singulated from the carrier strip 14 using a shearing die or by any other suitable singulation equipment as shown by block 96. Finally, the first and second terminations 30, 32 may be plated as shown by block 98. Various methods of plating are discussed in detail above.

Figure 10:
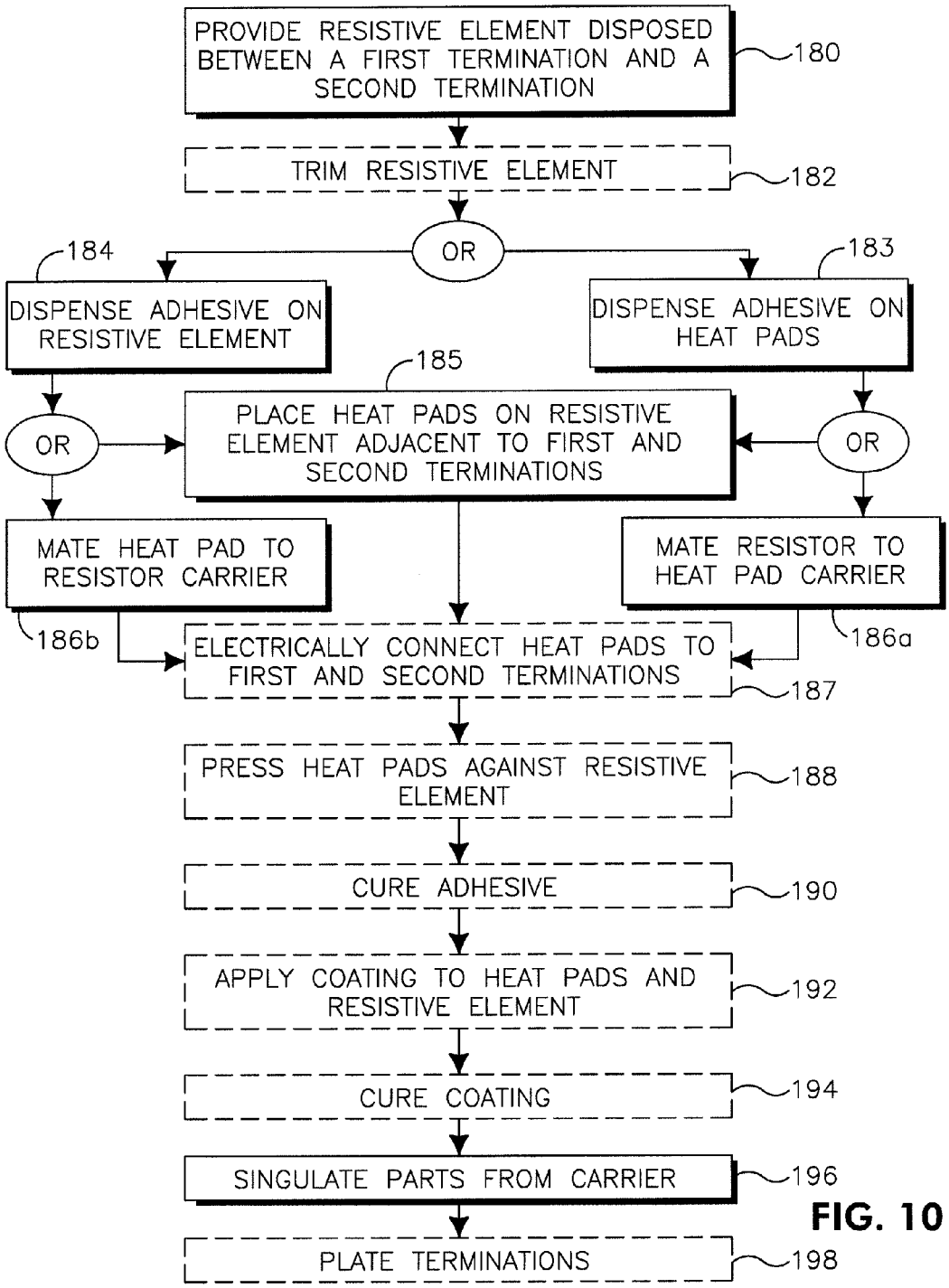
FIG. 10 is a flow diagram showing the process for making the present resistor according to other embodiments.
Figure 11:
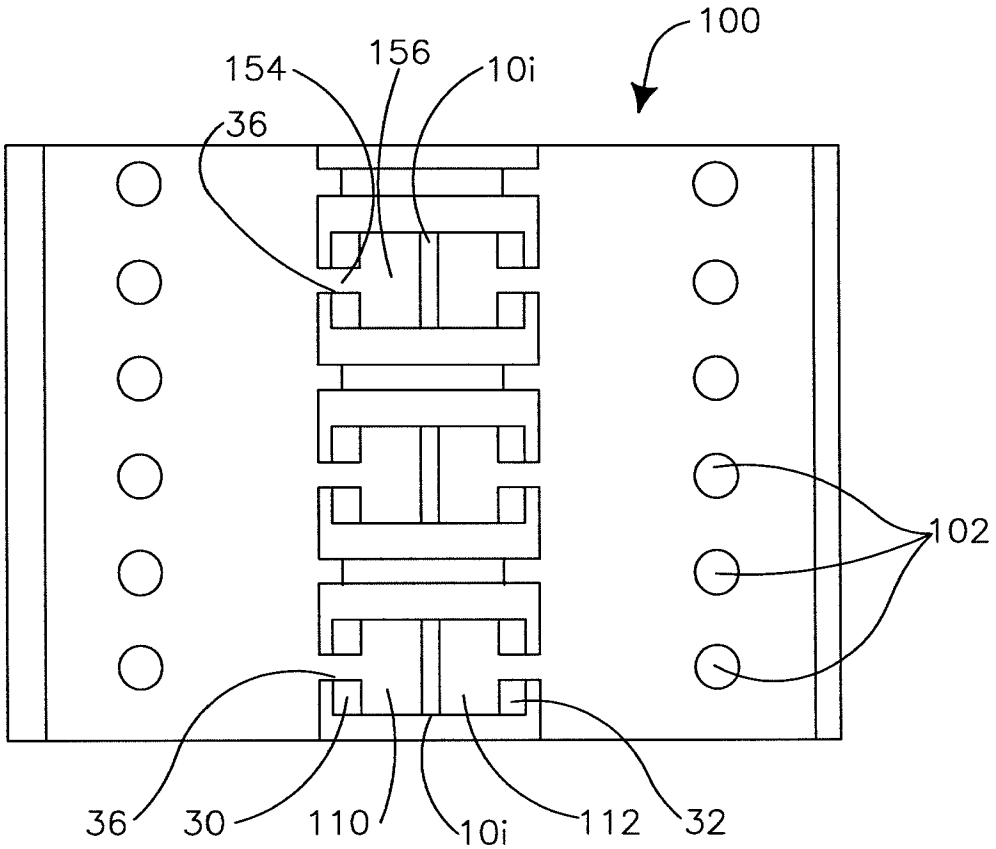
FIG. 11 illustrates a heat pad carrier mated to a plurality of metal strip resistors.

FIG. 10 is a flow diagram showing the process for making a resistor according to additional embodiments. Reference numbers to the embodiments shown in FIGS. 1-4 are included. It should be understood that the methods disclosed in FIG. 10 may be used to produce devices that differ structurally from the devices shown in FIGS. 1-4. According to one embodiment, a resistive element 20 is disposed between first and second terminations 30, 32 as shown by block 180. The resistive element 20 may then be optionally trimmed as shown by block 182. An adhesive may be dispensed onto the heat pads 50, 52 as shown by block 183 instead of the resistive element 20. The heat pads 50, 52 are placed on the resistive element 20 adjacent to the terminations 30, 32 as shown by block 185. The placement of the heat pads 50, 52 may cause the heat pads to be in thermal contact with the terminations 30, 32. Alternatively, heat pads 110, 112 may be located on a heat pad carrier 100, as illustrated in FIG. 11, in which case the resistor is mated to the heat pad carrier 100 as shown by block 186*a* such that first and second heat pads 110, 112 having the adhesive 40 are adjacent to the first and second terminations 30, 32, respectively. The heat pads 110, 112 may also be in thermal contact with the first and second terminations 30, 32. In another embodiment, the adhesive 40 is dispensed on the resistive element 20 as shown by block 184. The resistor 10 may be located on a resistor carrier, in which case the heat pads 110, 112 are mated to the resistor carrier as shown in block 186*b* such that the heat pads 110, 112 are adjacent to the terminations 30, 32 and optionally in thermal contact with the terminations 30, 32. In all of the above embodiments, the first and second heat pads 50, 52, 110, 112 may optionally be electrically connected to the first and second terminations 30, 32, respectively, as shown by block 187. The remaining operations, including pressing the heat pads shown in block 188, curing the adhesive shown in block 190, applying and curing the coating shown in blocks 192 and 194, singulating the resistors from the carrier shown in block 196 and plating the terminations shown in block 198 remain the same as in the embodiment disclosed in FIG. 9.

FIG. 11 shows the heat pad carrier 100 containing a plurality of first and second heat pads 110, 112. The heat pad carrier 100 may also include a plurality of index holes 102 to align the carrier 100 during manufacturing. A plurality of metal strip resistors 10*i* are mated to the heat pad carrier 100 such that for each metal strip resistor 10*i*, the first and second heat pads 110, 112 are adjacent to the first and second terminations 30, 32, respectively. Optionally, the heat pads 110, 112 may be in thermal contact with and/or electrically connected to the terminations 30, 32. Then, the metal strip resistors with heat pads 110, 112 may be separated from the heat pad carrier 100. In one embodiment the first and second terminations 30, 32 each includes a bifurcation 36, and each one of the plurality of first and second heat pads 110, 112 on the heat pad carrier 100 has a tab portion 154 and a pad portion 156. The tab portion 154 of each heat pad is adapted to fit in between the bifurcation 36 of the first and second terminations 30, 32. This arrangement enhances the electrical connection between the heat pads 110,112 and the terminations 30, 32, ensures proper alignment of the heat pads 110, 112 on the resistor 10*i*, and also improves heat dissipation.

Having thus described the present resistor in detail, it is to be appreciated and will be apparent to those skilled in the art that many physical changes, only a few of which are exemplified in the detailed description above, could be made without altering the inventive concepts and principles embodied therein. It is also to be appreciated that numerous embodiments incorporating only part of the preferred embodiment are possible which do not alter, with respect to those parts, the inventive concepts and principles embodiment therein. The present embodiments and optional configurations are therefore to be considered in all respects as exemplary and/or illustrative and not restrictive.

What is claimed is:

1. A metal strip resistor comprising:

a resistive element disposed between a first termination and a second termination, wherein the resistive element, first termination and second termination form a substantially flat plate;

first and second heat pads placed on top of a thermal interface material and adjacent to the first termination and the second termination, respectively; and the thermal interface material disposed between and in direct contact with the resistive element and the first and second heat pads.

2. The metal strip resistor of claim 1, wherein the first and second heat pads are electrically connected to the first and second terminations, respectively.

3. The metal strip resistor of claim 1, wherein the first and second heat pads are in thermal contact with the first and second terminations, respectively.

4. The metal strip resistor of claim 1, wherein each of the first and second terminations comprises a bifurcation.

5. The metal strip resistor of claim 4, wherein each of the first and second heat pads is formed with a tab portion and a pad portion, the tab portion adapted to fit in between the bifurcation of the first and second terminations.

6. The metal strip resistor of claim 5, wherein the fit between the tab portion and the bifurcation is a slip fit.

7. The metal strip resistor of claim 1, further comprising a coating disposed over the first and second heat pads and the resistive element, wherein the coating is electrically non-conductive.

8. The metal strip resistor of claim 1, wherein the first and second terminations and the first and second heat pads are made from the same electrically conductive material.

9. The metal strip resistor of claim 1, wherein the first and second terminations are configured for mounting to an electrical circuit board having two or more electrical conductors thereon.

10. The metal strip resistor of claim 1, wherein the thermal interface material is an adhesive.

11. The metal strip resistor of claim 1, wherein the first termination is welded to a first end of the resistive element and the second termination is welded to a second end of the resistive element.

12. The metal strip resistor of claim 1, wherein the thermal interface material is dispensed on at least two separate locations on a top surface of the resistive element, one of the at least two locations being adjacent to the first termination and the other of the at least two locations being adjacent to the second termination.

13. The metal strip resistor of claim 1, wherein the resistive element has a thickness defined between a top surface and a bottom surface, and the first and second terminations each has a thickness defined between a top surface and a bottom surface, the thicknesses of the first and second terminations being substantially equal to each other and greater than the thickness of the resistive element.

14. The metal strip resistor of claim 13, wherein the bottom surface of the resistive element is flush with the bottom surfaces of the first and second terminations.

15. The metal strip resistor of claim 13, wherein the first and second heat pads each have a thickness that is substantially equal to each other, and a sum of the thickness of the resistive element, a thickness of the thermal interface material, the thickness of the first and second heat pads, and a thickness of a coating disposed over the first and second heat pads is no greater than the thickness of the first and second terminations.

16. The metal strip resistor of claim 15, wherein the thickness of the first and second terminations ranges from 0.01 inches to 0.04 inches.

17. The metal strip resistor of claim 10, wherein the adhesive comprises a polymer and spherical alumina particles.

18. The metal strip resistor of claim 7, wherein the coating comprises a silicon polyester material.

19. A method for making a metal strip resistor, the method comprising:

providing a resistive element disposed between a first termination and a second termination, wherein the resistive element, first termination, and second termination form a substantially flat plate;

providing first and second heat pads;

dispensing a thermal interface material on at least one of the resistive element or the first and second heat pads, wherein the thermal interface material is thermally conductive and electrically non-conductive; and placing the first and second heat pads on top of the resistive element and adjacent to the first and second terminations, respectively, wherein the thermal interface material is disposed between and in direct contact with the resistive element and the first and second heat pads.

20. The method of claim 19, wherein each of the first and second terminations comprises a bifurcation.

21. The method of claim 19, wherein each of the first and second heat pads is formed with a tab portion and a pad portion, the tab portion adapted to fit in between the bifurcation of the first and second terminations.

22. The method of claim 19, further comprising coating the first and second heat pads and the resistive element with an electrically non-conductive material.

23. The method of claim 19, wherein the thermal interface material is dispensed on at least two separate locations on a top surface of the resistive element, one of the at least two locations being adjacent to the first termination and the other of the at least two locations being adjacent to the second termination.

24. The method of claim 19, wherein the resistive element has a thickness defined between a top surface and a bottom surface, and the first and second terminations each has a thickness defined between a top surface and a bottom surface, the thicknesses of the first and second terminations being substantially equal to each other and greater than the thickness of the resistive element.

25. The method of claim 24, wherein the thickness of the first and second terminations ranges from 0.01 inches to 0.04 inches.

26. The method of claim 19, wherein the thermal interface material is an adhesive.

27. The method of claim 26, wherein the adhesive comprises a polymer and spherical alumina particles.

28. The method of claim 19 wherein the first and second heat pads are coupled to a heat pad carrier that facilitates placing the first and second heat pads on top of the resistive element.

29. The method of claim 19, further comprising electrically connecting the first and second heat pads to the first and second terminations, respectively.

30. The method of claim 19, wherein the first and second heat pads are in thermal contact with the first and second terminations, respectively.

31. A metal strip resistor comprising:

a resistive element disposed between a first termination and a second termination, wherein the resistive element, first termination and second termination form a substantially flat plate;

first and second heat pads placed on top of a thermal interface material and adjacent to the first termination and the second termination, respectively;

the thermal interface material disposed between and the resistive element and the first and second heat pads;

wherein each of the first and second terminations comprises a bifurcation; and, wherein each of the first and second heat pads is formed with a tab portion and a pad portion, the tab portion adapted to fit in between the bifurcation of the first and second terminations.

32. The metal strip resistor of claim 31, wherein the fit between the tab portion and the bifurcation is a slip fit.

33. A metal strip resistor comprising:

a resistive element disposed between a first termination and a second termination, wherein the resistive element, first termination and second termination form a substantially flat plate;

first and second heat pads placed on top of a thermal interface material and adjacent to the first termination and the second termination, respectively;

the thermal interface material disposed between and the resistive element and the first and second heat pads;

wherein the resistive element has a thickness defined between a top surface and a bottom surface, and the first and second terminations each has a thickness defined between a top surface and a bottom surface, the thicknesses of the first and second terminations being substantially equal to each other and greater than the thickness of the resistive element; and, wherein the bottom surface of the resistive element is flush with the bottom surfaces of the first and second terminations.

34. A metal strip resistor comprising:

a resistive element disposed between a first termination and a second termination, wherein the resistive element, first termination and second termination form a substantially flat plate;

first and second heat pads placed on top of a thermal interface material and adjacent to the first termination and the second termination, respectively;

the thermal interface material disposed between and the resistive element and the first and second heat pads;

wherein the resistive element has a thickness defined between a top surface and a bottom surface, and the first and second terminations each has a thickness defined between a top surface and a bottom surface, the thicknesses of the first and second terminations being substantially equal to each other and greater than the thickness of the resistive element; and, wherein the first and second heat pads each have a thickness that is substantially equal to each other, and a sum of the thickness of the resistive element, a thickness of the thermal interface material, the thickness of the first and second heat pads, and a thickness of a coating disposed over the first and second heat pads is no greater than the thickness of the first and second terminations.

35. The metal strip resistor of claim 34, wherein the thickness of the first and second terminations ranges from 0.01 inches to 0.04 inches.

36. A method for making a metal strip resistor, the method comprising:

providing a resistive element disposed between a first termination and a second termination, wherein the resistive element, first termination, and second termination form a substantially flat plate;

providing first and second heat pads; dispensing a thermal interface material on at least one of the resistive element or the first and second heat pads, wherein the thermal interface material is thermally conductive and electrically non-conductive; and, placing the first and second heat pads on top of the resistive element and adjacent to the first and second terminations, respectively, wherein each of the first and second heat pads is formed with a tab portion and a pad portion, the tab portion adapted to fit in between the bifurcation of the first and second terminations.

37. A method for making a metal strip resistor, the method comprising:

providing a resistive element disposed between a first termination and a second termination, wherein the resistive element, first termination, and second termination form a substantially flat plate;

providing first and second heat pads; dispensing a thermal interface material on at least one of the resistive element or the first and second heat pads, wherein the thermal interface material is thermally conductive and electrically non-conductive; and, placing the first and second heat pads on top of the resistive element and adjacent to the first and second terminations, respectively, wherein the resistive element has a thickness defined between a top surface and a bottom surface, and the first and second terminations each has a thickness defined between a top surface and a bottom surface, the thicknesses of the first and second terminations being substantially equal to each other and greater than the thickness of the resistive element.

38. The method of claim 37, wherein the thickness of the first and second terminations ranges from 0.01 inches to 0.04 inches.

* * * * *